US005437741A

United States Patent [19]

Ozaki et al.

[11] Patent Number: 5,437,741

[45] Date of Patent: Aug. 1, 1995

[54] CORROSION-RESISTANT RARE EARTH METAL-TRANSITION METAL-BORON PERMANENT MAGNETS

[75] Inventors: Yukiko Ozaki; Michio Shimotomai; Yasutaka Fukuda; Akira Fujita; Yoko Kitano; Junichi Shimomura, all of Chiba, Japan

[73] Assignee: Kawasaki Steel Corporation, Japan

[21] Appl. No.: 238,330

[22] Filed: May 5, 1994

Related U.S. Application Data

[63] Continuation-in-part of Ser. No. 687,927, Jun. 5, 1991, abandoned.

[30] Foreign Application Priority Data

Oct. 9, 1990 [JP] Japan ..... 2-269635
May 14, 1993 [JP] Japan ..... 5-113168

[51] Int. Cl.[6] ..... H01F 1/057

[52] U.S. Cl. ..... 148/302; 420/82; 420/121; 75/244

[58] Field of Search ..... 148/302; 420/83, 121; 75/244

[56] References Cited

U.S. PATENT DOCUMENTS 4,792,368 12/1988 Sagawa et al. ..... 148/302

*Primary Examiner*—John Sheehan
*Attorney, Agent, or Firm*—Parkhurst, Wendel & Rossi

[57] ABSTRACT

A corrosion-resistant rare earth metal-transition metal-boron permanent magnet having improved corrosion resistance and excellent magnetic properties, including RE: 10–25 at % (where RE is at least one of Y, Sc and lanthanides), B: 2–20 at % and the remainder being substantially Fe, Co and Ni. In this case, the magnet has an average crystal grain size of 0.1–50 μm and includes a crystal grain boundary phase of $RE(Ni_{1-x-y}Co_xFe_y)$ compound having a thickness of not more than 10 μm.

4 Claims, No Drawings

CORROSION-RESISTANT RARE EARTH METAL-TRANSITION METAL-BORON PERMANENT MAGNETS

This application is a continuation-in-part of application Ser. No. 07/687,927 filed on Jun. 5, 1991 now abandoned.

BACKGROUND OF THE INVENTION

1. Field of the Invention

This invention relates to rare earth metal-transition metal-boron permanent magnets, and more particularly to a rare earth metal-transition metal-boron permanent magnet having improved corrosion resistance.

2. Description of the Related Art

The use of rare earth metal magnets of high energy product type has rapidly increased recently in accordance with the miniaturization and high efficiency of electronic parts. Among them, Nd—Fe—B type magnets are particularly preferential in place of Sm—Co type magnets. The Nd—Fe—B magnets are advantageous in resource and also exhibit excellent magnetic properties capable of attaining a high energy product as compared with the Sm—Co type magnet (as described in JP-B-61-34242).

In the Nd—Fe—B type magnet, however, neodymium as a light rare earth metal and iron are used as main components, so that the corrosion resistance is poor. That is, this magnet produces rust with the lapse of time even in a normal atmosphere. Such an occurrence of rust considerably degrades the reliability of the magnet, which obstructs the application of the magnet in wider environments.

In this connection, the inventors have proposed alloys obtained by compositely substituting a part of Fe with Co and Ni in JP-A-2-4939 and magnets prepared by mixing $RE_2TM_{14}B$ with RE-TM alloy in JP-A-3-250607 as a means for improving the corrosion resistance.

SUMMARY OF THE INVENTION

The invention is concerned with the improvement of the above technique for improving the corrosion resistance and is to provide a corrosion-resistant rare earth metal-transition metal-boron permanent magnet having a more improved corrosion resistance.

It is considered that the poor corrosion resistance of the conventional RE-TM-B type magnet results from an electrochemically less-noble Nd rich phase existing in a crystal grain boundary phase.

In this connection, the inventors have tried to improve the corrosion resistance by changing such a crystal grain boundary phase into a more noble phase and discovered that RE(Ni, Co, Fe) phase is preferable as a noble crystal grain boundary phase. Furthermore, it was discovered that it is important to control the thickness and the average crystal grain size of the latter phase to given ranges in order to simultaneously establish the magnetic properties and the corrosion resistance. The present invention is based on these discoveries.

According to a first aspect of the invention, there is the provision of a corrosion-resistant rare earth metal-transition metal-boron permanent magnet consisting essentially of RE: 10–25 at % (where RE is at least one of Y, Sc and lanthanides), B: 2–20 at % and the remainder being substantially Fe, Co and Ni, in which said magnet has an average crystal grain size of 0.1–50 μm and includes a crystal grain boundary phase consisting of $RE(Ni_{1-x-y}Co_xFe_y)$ compound (where $0 \leqq x \leqq 0.5$ and $0 \leqq y \leqq 0.4$) having a thickness of not more than 10 μm.

According to a second aspect of the invention, there is the provision of a corrosion-resistant rare earth metal-transition metal-boron permanent magnet consisting essentially of RE: 10–25 at % (where RE is at least one of Y, Sc and lanthanides), B: 2–20 at %, M: not more than 8 at % (wherein M is at least one of Mg, Al, Si, Ca, Ti, V, Cr, Mn, Cu, Zn, Ga, Ge, Zr, Nb, Hf, Mo, In, Sn, Pd, Ag, Cd, Sb, Pt, Au, Pb, Bi, Ta and W) and the remainder being substantially Fe, Co and Ni, in which said magnet has an average crystal grain size of 0.1–50 μm and includes a crystal grain boundary phase consisting of $RE(Ni_{1-x-y}Co_xFe_yM_z)$ compound (where $0 \leqq x \leqq 0.5$, $0 \leqq y \leqq 0.4$ and $0 \leqq z \leqq 0.1$) having a thickness of not more than 10 μm.

DESCRIPTION OF THE PREFERRED EMBODIMENTS

At first, the reason why the chemical composition of the magnet according to the invention is limited to the above range will be described below.

RE: 10–25 at %

RE is an element indispensable for the formation of $RE_2TM_{14}B$ as a ferromagnetic main phase. When the amount of RE is less than 10 at %, it is difficult to stably form such a main phase and a high coercive force is not obtained, while when it exceeds 25 at %, the amount of transition metal element (hereinafter abbreviated as TM) such as Fe, Co and Ni necessarily reduces to lower energy product. Therefore, the amount of RE alone or in admixture should be within a range of 10–25 at %.

B: 2–20 at %

B is also an element indispensable for the formation of $RE_2TM_{14}B$ main phase. When the B amount is less than 2 at %, stable formation of the main phase is difficult, while when it exceeds 20 at %, the amount of TM is reduced to lower the magnetic flux density. Therefore, the B amount should be within a range of 2–20 at %.

M (at least one of Mg, Al, Si, Ca, Ti, V, Cr, Mn, Cu, Zn, Ga, Ge, Zr, Nb, Hf, Mo, In, Sn, Pd, Ag, Cd, Sb, Pt, Au, Pb, Bi, Ta and W): Not More Than 8 at %

These elements effectively contribute to improve the coercive force and squareness and are usable for obtaining high energy product. When the amount of M exceeds 8 at %, there is no effect of improving the coercive force and also the amount of the other elements is decreased to degrade the magnetic properties, so that the upper limit of M amount should be 8 at %.

Fe, Co and Ni: Remainder

All transition metal elements of Fe, Co and Ni contribute to develop strong magnetism in the formation of the main phase. Particularly, Co and Ni are elements usable for effectively contributing to improve the corrosion resistance in the formation of the crystal grain boundary phase.

The amount of each transition metal element used is not particularly limited, but it is preferably within the following range:

Fe: 10–73 at %,

Co: 7–50 at %,

Ni: 5–30 at %, (Fe+Co+Ni): 55–88 at %.

The reason why the crystal grain boundary phase is limited to RE ($Ni_{1-x-y}Co_xFe_y$ or $Ni_{1-x-y-z}Co_xFe_yM_z$) and the thickness of the crystal grain boundary phase is limited to not more than 10 μm and the average crystal grain size of the magnet (i.e. sintered body) is limited to a range of 0.1–50 μm will be described as follows.

The inventors have made observations on microstructure of the magnet exhibiting good corrosion resistance among magnets according to the invention and found that an intermetallic compound having a CrB structure with a RE:TM ratio of 1:1 is existent in the crystal grain boundary phase. Further, it has been confirmed that the crystal grain boundary phase of such an intermetallic compound is very important in the improvement of corrosion resistance. Thus, according to the invention, the crystal grain boundary phase is limited to RE ($Ni_{1-x-y}Co_xFe_y$) or RE ($Ni_{1-x-y-z}Co_xFe_yM_z$) phase.

In this case, the reason why x, y and z are limited to $0 \leqq x \leqq 0.5$, $0 \leqq y \leqq 0.4$ and $0 \leqq z \leqq 0.1$, respectively, is due to the fact that when the values of x, y and z exceed the upper limits, $RE_1TM_1$ phase can not stably be formed and the crystal grain boundary phase is separated into TM rich phase and RE rich phase to degrade the corrosion resistance and magnetic properties. The reason why the crystal grain boundary phase should not exceed 10 μm is because the crystal grain boundary phase of RE ($Ni_{1-x-y}Co_xFe_y$) or RE ($Ni_{1-x-y-z}Co_xFe_yM_z$) surrounds $RE_2TM_{14}B$ as a main phase to largely contribute to the improvement of the corrosion resistance. Furthermore, such a crystal grain boundary phase suppresses the occurrence of reversed magnetic domain from the crystal grain boundary main phase to enhance the coercive force. However, when the thickness of the crystal grain boundary phase exceeds 10 μm, the ratio of other phase becomes relatively small to lower the residual magnetic flux density. Therefore, the upper limit of the thickness in the crystal grain boundary phase should be 10 μm. The thickness is preferably within a range of 0.01–1 μm.

The method of controlling the thickness of the crystal grain boundary phase will concretely be described below but is not intended as limitation thereof because the thickness control is different in accordance with the production method of the magnet.

In order to control the thickness of the crystal grain boundary phase to not more than 10 μm, the temperature rising rate over a range of 600°–800° C. in the sintering is sufficient to be 0.1°–50° C./min as mentioned below.

The melting point of the crystal grain boundary phase is about 700° C. Therefore, the temperature rising rate near to this melting point largely influences the precipitation form of the crystal grain boundary phase in the magnet. That is, when the temperature rising rate exceeds 50° C./min, the crystal grain boundary phase rapidly melts and can not uniformly extend around the main phase and hence a coarsened grain boundary phase is formed. On the other hand, the lower limit is not critical from a viewpoint of the properties, but when the temperature rising rate is too small, the sintering time becomes considerably long, which increases the production cost. Preferably, the lower limit is about 0.1° C./min. The reason why the average crystal grain size of the magnet is limited to 0.1–50 μm will now be explained.

The crystal grain size is particularly interrelated to the coercive force. When the average crystal grain size exceeds 50 μm, the coercive force undesirably lowers. When it is less than 0.1 μm, the coercive force and magnetic flux density undesirably lower. Therefore, the average crystal grain size in the magnet should be within a range of 0.1–50 μm.

As the production of the magnet according to the invention, a sintering process is particularly suitable, but a ribbon quenching process, a casting process and the like are applicable.

In the sintering process, a molten alloy having a given chemical composition is rendered into an ingot, which is finely pulverized to an average grain size of 2–3 μm through a jaw crusher, a Brown mill and a jet mill. The thus obtained fine powder is shaped in an orientational magnetic field of about 12 kOe and then sintered under vacuum at a temperature of about 1000°–1100° C.

The following example is given in illustration of the invention and is not intended as a limitation thereof.

Each of various alloy ingots having a chemical composition as shown in Tables 1 and 2 is finely pulverized through a jaw crusher, a Brown mill and a jet mill to an average grain size of 2–3 μm, shaped in a magnetic field of 12 kOe and then sintered at 1000°–1100° C. under vacuum. After the sintering, the resulting sintered body is subjected to an annealing at 400°–700° C., if necessary.

The average crystal grain size of the resulting sintered body, composition and thickness of crystal grain boundary phase and magnetic properties and corrosion resistance are measured to obtain results as shown in Tables 3 and 4.

Moreover, the average crystal grain size is quantified as follows. That is, after the surface of the sintered body is polished and etched, the structure of the surface is photographed by means of an optical microscope of about 400–800 magnifications and a circle of a given area is drawn thereon and then the number of grains existent in the circle is measured, from which the average crystal grain size is calculated. The thickness of the crystal grain boundary phase is measured by means of a transmission electron microscope having a high resolution.

The corrosion resistance is evaluated by an area ratio of rust produced when being subjected to a corrosion test at a temperature of 70° C. and a relative humidity of 95% for 48 hours. When the area ratio of rust produced is not more than 5%, it is possible to apply the sintered body to electronic parts.

TABLE 1

| | Chemical composition (at %) | | | | | | Annealing | Temperature |
|---|---|---|---|---|---|---|---|---|
| No. | RE | Fe | Co | Ni | B | Additional element | temperature (°C.) | rising rate at 600–800° C. |
| 1 | Nd 15 | 48 | 20 | 9 | 8 | — | none | 10 C./min |
| 2 | Nd 14 | 42.5 | 25 | 10 | 7 | Ti 1.5 | 450 | |
| 3 | Nd 15 | 45 | 22 | 9 | 8 | Ga 1.0 | none | |
| 4 | Nd 10 | 44.5 | 23 | 11 | 8 | V 0.5 | none | |

TABLE 1-continued

| No. | RE | Fe | Co | Ni | B | Additional element | Annealing temperature (°C.) | Temperature rising rate at 600–800° C. |
|---|---|---|---|---|---|---|---|---|
| | Dy 3 | | | | | | | |
| 5 | Pr 7 | 36.5 | 30 | 10 | 7 | Ti 1.0 | 500 | |
| | Nd 7 | | | | | Ga 1.5 | none | |
| 6 | Nd 15 | 39 | 27 | 9 | 8 | Nb 2.0 | none | 0.2° C./min |
| 7 | Nd 10 | 45 | 22 | 9 | 8 | Si 1.0 | none | |
| | Dy 5 | | | | | | | |
| 8 | Pr 17 | 44 | 21 | 10 | 7 | Zr 1.0 | none | |
| 9 | Pr 12 | 45 | 21 | 11 | 7 | Mo 1.0 | 420 | |
| | Dy 3 | | | | | | | |
| 10 | Nd 13 | 43.5 | 22 | 11 | 8 | Ta 2.5 | none | 48° C./min |
| 11 | Pr 23 | 35 | 25 | 10 | 7 | — | 400 | |
| 12 | Nd 15 | 47 | 23 | 12 | 3 | — | none | |
| 13 | Nd 13 | 31 | 27 | 11 | 18 | — | none | |
| 14 | Y 3 | 53 | 2 | 21 | 6 | Nb 1.0 | none | 20° C./min |
| | Nd 13 | | | | | In 1.0 | | |
| 15 | Nd 14 | 38.5 | 25 | 13 | 5 | Hf 1.5 | none | |
| | Sm 1 | | | | | Sn 2.0 | | |
| 16 | Pr 13 | 50 | 5 | 22 | 7 | W 1.5 | 400 | |
| | La 1 | | | | | | | |
| | Eu 0.5 | | | | | | | |

TABLE 2

| No. | RE | Fe | Co | Ni | B | Additional element | Annealing temperature (°C.) | Temperature rising rate at 600–800° C. |
|---|---|---|---|---|---|---|---|---|
| 17 | Nd 15 | 39.5 | 23 | 11 | 10 | Ga 0.5 | 450 | 15° C./min |
| | Gd 1 | | | | | | | |
| 18 | Nd 8 | 50 | 3 | 20 | 8 | Al 1.0 | none | |
| | Pr 9 | | | | | | | |
| | Tb 1 | | | | | | | |
| 19 | Nd 11 | 36.5 | 30 | 12 | 7 | Mg 0.5 | none | |
| | Ho 3 | | | | | | | |
| 20 | Nd 14 | 38 | 30 | 10 | 6 | Ca 1.0 | 450 | |
| | Er 1 | | | | | | | |
| 21 | Pr 13 | 38 | 27 | 11 | 9 | Cr 1.5 | 450 | 7° C./min |
| | Tm 0.5 | | | | | | | |
| 22 | Nd 16 | 35.5 | 27 | 11 | 8 | Mn 1.0 | | |
| | Yb 0.5 | | | | | Cu 1.0 | none | |
| 23 | Nd 14 | 40.3 | 29 | 10 | 5 | Zn 0.5 | none | |
| | Lu 0.7 | | | | | Ge 0.5 | | |
| 24 | Nd 15 | 40.5 | 23 | 11 | 9 | Pd 0.5 | 450 | 10° C./min |
| | Dy 1 | | | | | | | |
| 25 | Nd 11 | 36.5 | 30 | 10 | 8 | Ag 0.5 | 450 | |
| | Pr 3 | | | | | Cd 1.0 | | |
| 26 | Nd 15 | 36.5 | 30 | 10 | 8 | Sb 0.5 | none | 5° C./min |
| | | | | | | Ti 1.0 | | |
| 27 | Nd 14 | 38.0 | 27 | 11 | 7 | Pt 0.5 | none | 15° C./min |
| | | | | | | Ga 2.0 | | |
| | | | | | | Au 0.5 | | |
| 28 | Nd 15 | 40 | 25 | 10 | 9 | Pb 0.5 | 430 | |
| | | | | | | Bi 0.5 | | |
| 29 | Nd 21 | 73 | 0 | 0 | 6 | — | 620 | 10° C./min |
| 30 | Nd 20 | 60 | 13 | 0 | 7 | — | 600 | |
| 31 | Nd 19 | 56 | 15 | 2 | 6 | V 2.0 | 550 | |
| 32 | Nd 20 | 72 | 0 | 2 | 5 | Mo 1.0 | 700 | |
| 33 | Nd 21 | 72 | 0 | 0 | 7 | — | 630 | |

TABLE 3

| No. | Average crystal grain size (μm) | Crystal grain boundary phase | Thickness of crystal grain boundary phase (μm) | Magnetic properties Br (kG) | iHc (kOe) | $(BH)_{max}$ (MGOe) | Area ratio of rust produced (%) | Remarks |
|---|---|---|---|---|---|---|---|---|
| 1 | 17 | Nd $(Ni_{0.8}Co_{0.2})$ | 0.2 | 12.0 | 8 | 33 | 0 | First acceptable example |
| 2 | 5 | Nd$(Ni_{0.7}Co_{0.3})$ | 0.2 | 11.5 | 10 | 30 | 0 | Second acceptable example |
| 3 | 9 | Nd$(Ni_{0.9}Co_{0.1})$ | 0.1 | 11.7 | 12 | 31 | 0 | Second acceptable example |
| 4 | 10 | $(Nd_{0.75}Dy_{0.25})$ $(Ni_{0.7}Co_{0.3})$ | 0.3 | 10.6 | 18 | 26 | 0 | Second acceptable |

TABLE 3-continued

| No. | Average crystal grain size (μm) | Crystal grain boundary phase | Thickness of crystal grain boundary phase (μm) | Magnetic properties Br (kG) | iHc (kOe) | $(BH)_{max}$ (MGOe) | Area ratio of rust produced (%) | Remarks |
|---|---|---|---|---|---|---|---|---|
| | | | | | | | | example |
| 5 | 7 | $(Pr_{0.5}Nd_{0.5})(Ni_{0.9}Co_{0.1})$ | 0.4 | 11.3 | 12 | 29 | 0 | Second acceptable example |
| 6 | 3 | $Nd(Ni_{0.8}Co_{0.2})$ | 0.2 | 11.9 | 10 | 32 | 0 | Second acceptable example |
| 7 | 8 | $(Nd_{0.65}Dy_{0.35})(Ni_{0.9}Co_{0.1})$ | 0.2 | 10.3 | 20 | 24 | 0 | Second acceptable example |
| 8 | 3 | $Pr(Ni_{0.8}Co_{0.2})$ | 0.3 | 11.8 | 13 | 31 | 1 | Second acceptable example |
| 9 | 10 | $(Pr_{0.8}Dy_{0.2})(Ni_{0.9}Co_{0.1})$ | 0.3 | 10.7 | 17 | 26 | 0 | Second acceptable example |
| 10 | 7 | $Nd(Ni_{0.7}Co_{0.3})$ | 0.2 | 10.8 | 12 | 27 | 0 | Second acceptable example |
| 11 | 15 | $Pr(Ni_{0.8}Co_{0.2})$ | 0.4 | 10.0 | 17 | 22 | 0 | First acceptable example |
| 12 | 7 | $Nd(Ni_{0.6}Co_{0.4})$ | 0.2 | 11.2 | 10 | 29 | 0 | First acceptable example |
| 13 | 5 | $Nd(Ni_{0.6}Co_{0.4})$ | 0.1 | 10.1 | 12 | 24 | 0 | First acceptable example |
| 14 | 9 | $(Nd_{0.9}Y_{0.1})(Ni_{0.6}Co_{0.2}Fe_{0.2})$ | 1.2 | 9.5 | 14 | 22 | 0 | Second acceptable example |
| 15 | 12 | $(Nd_{0.95}Sm_{0.05})(Ni_{0.8}Co_{0.2})$ | 0.5 | 10.5 | 12 | 25 | 0 | Second acceptable example |
| 16 | 7 | $(Pr_{0.8}La_{0.1}Eu_{0.1})(Ni_{0.5}Co_{0.1}Fe_{0.4})$ | 5.7 | 9.5 | 15 | 21 | 1 | Second acceptable example |

TABLE 4

| No. | Average crystal grain size (μm) | Crystal grain boundary phase | Thickness of crystal grain boundary phase (μm) | Magnetic properties Br (kG) | iHc (kOe) | $(BH)_{max}$ (MGOe) | Area ratio of rust produced (%) | Remarks |
|---|---|---|---|---|---|---|---|---|
| 17 | 25 | $(Nd_{0.9}Gd_{0.1})(Ni_{0.7}Co_{0.3})$ | 0.7 | 10.8 | 12 | 26 | 0 | Second acceptable example |
| 18 | 10 | $(Nd_{0.5}Pr_{0.4}Tb_{0.1})(Ni_{0.8}Fe_{0.2})$ | 0.2 | 9.3 | 11 | 20 | 1 | Second acceptable example |
| 19 | 10 | $(Nd_{0.9}Ho_{0.1})(Ni_{0.9}Co_{0.1})$ | 0.3 | 10.5 | 13 | 24 | 0 | Second acceptable example |
| 20 | 48 | $(Nd_{0.9}Er_{0.1})(Ni_{0.7}Co_{0.2}Fe_{0.1})$ | 0.2 | 11.0 | 12 | 29 | 0 | Second acceptable example |
| 21 | 10 | $(Pr_{0.9}Tm_{0.1})(Ni_{0.6}Co_{0.3}Fe_{0.1})$ | 0.5 | 10.9 | 12 | 28 | 0 | Second acceptable example |
| 22 | 12 | $(Nd_{0.95}Yb_{0.05})(Ni_{0.8}Co_{0.2})$ | 1.2 | 10.0 | 15 | 22 | 0 | Second acceptable example |
| 23 | 15 | $(Nd_{0.9}Lu_{0.1})(Ni_{0.8}Co_{0.15}Fe_{0.05})$ | 0.7 | 11.0 | 13 | 28 | o | Second acceptable example |
| 24 | 3 | $(Nd_{0.9}Dy_{0.1})(Ni_{0.7}Co_{0.3})$ | 0.3 | 10.5 | 15 | 24 | 1 | Second acceptable example |
| 25 | 8 | $(Nd_{0.95}Lu_{0.05})(Ni_{0.7}Co_{0.25}Fe_{0.05})$ | 0.2 | 10.2 | 10 | 22 | 0 | Second acceptable example |
| 26 | 5 | $Nd(Ni_{0.75}Co_{0.20}Fe_{0.05})$ | 0.1 | 10.0 | 12 | 22 | 0 | Second acceptable example |
| 27 | 10 | $Nd(Ni_{0.7}Co_{0.3})$ | 1.0 | 10.0 | 12 | 23 | 0 | Second acceptable |

TABLE 4-continued

| No. | Average crystal grain size (μm) | Crystal grain boundary phase | Thickness of crystal grain boundary phase (μm) | Magnetic properties Br (kG) | iHc (kOe) | $(BH)_{max}$ (MGOe) | Area ratio of rust produced (%) | Remarks |
|---|---|---|---|---|---|---|---|---|
| 28 | 7 | $Nd(Ni_{0.8}Co_{0.2})$ | 0.9 | 10.5 | 10 | 23 | 1 | Second example acceptable |
| 29 | 12 | Nd rich $(Nd_{0.8}Fe_{0.2})$ | 12 | 10.0 | 10 | 20 | 60 | comparative example |
| 30 | 40 | $Nd_3Co$ | 14 | 8.5 | 9 | 16 | 40 | comparative example |
| 31 | 30 | $Nd_3Co$ | 13 | 8.5 | 6 | 15 | 35 | comparative example |
| 32 | 53 | $Nd_3Co$ | 13 | 9.2 | 3 | 19 | 38 | comparative example |
| 33 | 60 | $Nd_3Co$ | 12 | 9.6 | 4 | 21 | 37 | comparative example |

As seen from Tables 3 and 4, excellent magnetic properties and corrosion resistance are simultaneously obtained when the average crystal grain size is 0.1–50 μm and the crystal grain boundary phase is RE $(Ni_{1-x-y}Co_xFe_y$ or $Ni_{1-x-y-z}Co_xFe_yM_z)$ system and has a thickness of not more than 10 μm.

As mentioned above, according to the invention, rare earth metal-transition metal-boron permanent magnets having a high reliability can be provided with simultaneously establishing excellent magnetic properties and corrosion resistance.

What is claimed is:

1. A corrosion-resistant rare earth metal-transition metal-boron permanent magnet consisting essentially of:

RE: 10–25 at %, wherein RE is at least one of Y, Sc and lanthanides;

B: 2–20 at %; and the remainder being Fe: 10–73 at %, Co: 7–50 at % and Ni: 9–30 at %; provided that (Fe+Co+Ni) is 55–88 at %;

said magnet having an average crystal grain size of 0.1–50 μm and including a crystal grain boundary phase consisting of $RE(Ni_{1-x-y}Co_xFe_y)$ compound, wherein $0 \leqq x \leqq 0.5$ and $0 \leqq y \leqq 0.4$, said crystal grain boundary phase having a thickness of not more than 10 μm.

2. A corrosion-resistant rare earth metal-transition metal-boron permanent magnet consisting essentially of:

RE: 10–25 at %, wherein RE is at least one of Y, Sc and lanthanides;

B: 2–20 at %;

M: not more than 8 at %, wherein M is at least one of Mg, Al, Si, Ca, Ti, V, Cr, Mn, Cu, Zn, Ga, Ge, Zr, Nb, Hf, Mo, In, Sn, Pd, Ag, Cd, Sb, Pt, Au, Pb, Bi, Ta and W; and the remainder being Fe: 10–73 at %, Co: 7–50 at % and Ni: 9–30 at %, provided that (Fe+Co+Ni) is 55–88 at %;

said magnet having an average crystal grain size of 0.1–50 μm and including a crystal grain boundary phase consisting of $RE(Ni_{1-x-y}Co_xFe_yM_z)$ compound, wherein $0 \leqq x \leqq 0.5$, $0 \leqq y \leqq 0.4$ and $0 \leqq z \leqq 01$, said crystal grain boundary phase having a thickness of not more than 10 μm.

3. A corrosion-resistant rare earth metal-transition metal-boron permanent magnet according to claim 1, wherein said thickness is 0.01–1 μm.

4. A corrosion-resistant rare earth metal-transition metal-boron permanent magnet according to claim 2, wherein said thickness is 0.01–1 μm.

* * * * *

UNITED STATES PATENT AND TRADEMARK OFFICE

CERTIFICATE OF CORRECTION

PATENT NO. : 5,437,741

DATED : August 1, 1995

INVENTOR(S) : Yukiko OZAKI; Michio SHIMOTOMAI; Yasutaka FUKUDA; Akira FUJITA; Yoko KITANO; and Junichi SHIMOMURA It is certified that error appears in the above-indentified patent and that said Letters Patent is hereby corrected as shown below:

On the title page , column 1, [30], after line 2, insert the following:

| | | | | | |
|---|---|---|---|---|---|
| -- | Oct. 11, 1990 | [WO] | WIPO | PCT/JP90/01315 | |
| | Oct. 12, 1989 | [JP] | Japan | 1-263946 | |
| | Dec. 26, 1989 | [JP] | Japan | 1-335028 | --. |

Signed and Sealed this

Thirty-first Day of October 1995

Attest:

Bruce Lehman

BRUCE LEHMAN

Attesting Officer

Commissioner of Patents and Trademarks